US010111523B2

(12) United States Patent
Caratiola et al.

(10) Patent No.: US 10,111,523 B2
(45) Date of Patent: Oct. 30, 2018

(54) TABLE SYSTEM

(71) Applicant: aeris GmbH, Haar bei München (DE)

(72) Inventors: Tobias Caratiola, Munich (DE); Dietlind Walger-Hutter, Munich (DE)

(73) Assignee: aeris GmbH, Haar bei München (DE)

( * ) Notice: Subject to any disclaimer, the term of this patent is extended or adjusted under 35 U.S.C. 154(b) by 0 days.

(21) Appl. No.: 15/413,546

(22) Filed: Jan. 24, 2017

(65) Prior Publication Data

US 2017/0245638 A1 Aug. 31, 2017

(30) Foreign Application Priority Data

Feb. 26, 2016 (DE) ..... 10 2016 103 433

(51) Int. Cl.
*A47B 87/00* (2006.01)
*A47B 9/00* (2006.01)
*A47B 17/06* (2006.01)

(52) U.S. Cl.
CPC ..... *A47B 87/002* (2013.01); *A47B 9/00* (2013.01); *A47B 17/065* (2013.01)

(58) Field of Classification Search
CPC ... A47B 87/002; A47B 17/065; A47B 91/028; A47C 1/124; Y10T 403/32131; Y10T 403/32139; Y10T 403/32147; Y10T 403/32155; Y10T 403/32163; Y10T 403/32172
USPC ..... 108/64; 248/125.2, 188.7, 677, 188.8, 248/205.1; 211/182, 85.3
See application file for complete search history.

(56) References Cited

U.S. PATENT DOCUMENTS 884,280 A * 4/1908 Liden
1,185,779 A * 6/1916 Doolttle ..... A47B 21/0314 297/141
2,456,737 A * 12/1948 Scheuer ..... A47F 5/01 211/149
3,002,787 A * 10/1961 Ziegenfuss ..... A47C 1/124 108/185
3,303,246 A * 2/1967 Forrest ..... A47B 91/024 108/64
4,223,613 A * 9/1980 Yoshizawa ..... A47B 47/00 108/102
5,704,298 A * 1/1998 Corpuz, Jr. ..... A47B 17/065 108/50.01
5,987,839 A * 11/1999 Hamar ..... E04F 15/04 403/52
6,182,580 B1 * 2/2001 Barrett ..... A47B 87/002 108/64

(Continued)

FOREIGN PATENT DOCUMENTS

DE 87 00 081 U1 9/1987
DE 29719679 * 1/1998

(Continued)

*Primary Examiner* — Janet M Wilkens
(74) *Attorney, Agent, or Firm* — Harness, Dickey & Pierce, P.L.C.

(57) ABSTRACT

A workplace system has at least two workplace pieces of furniture that make a work surface available. The workpieces of the furniture are connected to one another by a rotary movable connection. The rotary movable connection runs along a floor. Each workpiece of the furniture has a V-shaped foot with two foot sections oriented at an angle β relative to one another. The feet are arranged adjacent to a lower end of a standing leg.

14 Claims, 4 Drawing Sheets

(56) References Cited

U.S. PATENT DOCUMENTS

| | | | | |
|---|---|---|---|---|
| 6,375,285 | B1 * | 4/2002 | Choi | B65D 5/5253 16/221 |
| 8,011,707 | B1 * | 9/2011 | Summers | A47C 1/124 280/47.35 |
| 2017/0224109 | A1 * | 8/2017 | Gammon | A47B 87/002 |

FOREIGN PATENT DOCUMENTS

| | | | |
|---|---|---|---|
| DE | 197 43 594 | A1 | 4/1999 |
| DE | 19845510 | * | 12/1999 |
| DE | 29915035 | * | 3/2000 |
| DE | 29922626 | * | 3/2000 |
| DE | 202010014601 | * | 1/2012 |
| EP | 0332096 | * | 9/1989 |
| EP | 0776618 | * | 6/1997 |
| FR | 1483176 | * | 6/1966 |
| WO | 2007070921 | * | 6/2007 |

* cited by examiner

SECTION A-A

TABLE SYSTEM

CROSS-REFERENCE TO RELATED APPLICATIONS

This application claims the benefit and priority of DE 10 2016 103 433.9, filed Feb. 26, 2016. The entire disclosure of the above application is incorporated herein by reference.

FIELD

The invention relates to a table system or workplace system consisting of at least two tables or workplaces.

BACKGROUND

In the case of tables and office workplaces known in the prior art the user is as a rule limited to a workplace with one table, which results in a predominantly sitting activity. Known tables and workplace systems are currently designed as individual functional units which are independent from each other and which the user can arrange in his desired arrangement. Conventional offices are therefore organized in such a manner that all working means such as telephone, keyboard, mouse, monitor and working means are located to the extent possible in reach. Such workplace systems frequently also have a rolling container in which additional working means are in the reach of the user. There are even Refa time studies which detect the times up to a tenth of a second about how a time-saving managing of work means and peripheral devices including printers and the removal of printed products can be realized.

The thought at the base of this concept that each tenth of a second of time saved in a rapid access to documents and working means increases the performance and the efficiency is correct for machines but not for the humans who should work at such workplaces.

What is decisive for humans are physiological and physical factors and properties about their performance and efficiency.

The increase of health-related injuries that are due to the "non-human-specific concerns" in conventional offices is reflected in the increasing patterns of diseases of humans who perform office work. More and more people are suffering from so-called civilization diseases produced by constant and hour-long rigid sitting in an office.

So-called actively dynamic seats have already been developed in the area of office chairs in order to make an active and "movable" sitting possible for the chair user. For example, a chair or a rocking chair is known from DE 44 00 395 A1 in which the sitting surface can incline in all directions by a guided articulation and an elastic return adjustment device. Another movable chair of the cited type is known from European patent EP 0 808 116 B1 as a rocking stool comprising a return adjustment device on a foot part. This return device is constructed from vibration-dampening metal and consists of a tubular upper part, a lower part and an elastic material arranged between the upper part and the lower part.

However, there is still the possibility here that the user or, for example, the office employee does not leave his chair very often and therefore still has a primarily sitting activity.

In past decades office workplaces were set up according to technical and economical viewpoints, sometimes even according to aesthetic viewpoints. Thoughts for designing the working environment of a human according to the requirements of his genetic nature and his physiological needs are novel and were previously unknown.

A disadvantage in the prior art is the fact that there are no suitable furniture systems for the user with are suitably designed technically so that an arrangement can be realized with them that can be changed but not shifted as desired.

Not every type of movement is basically good for a person and movement is not just movement but rather the quality of the movement is much more important, which is documented by the newest scientific knowledge. "Complex, spontaneous movements" are extremely positive for the human organism whereas predominantly "linear, forced movements" are rather disadvantageous for a person since they are often performed according to a given scheme or pattern and accordingly do not take place intuitively.

SUMMARY

Accordingly, the present disclosure has the task of making a table system and workplace system available which has such technical properties that a specific arrangement is possible for creating a defined workspace for a user of a table.

The basic concept of the present disclosure is to arrange relative to each other workplace furniture such as, for example, office tables by means of a movable connection arrangement in a distance range which can be changed but is nevertheless defined and in a defined angle range.

Therefore, a workplace system consisting of at least two workplace pieces of furniture is provided according to the disclosure which preferably makes a work surface (e.g., a table surface) available, wherein the workplace pieces of furniture are connected to one another by a rotary, movable connection means.

It can be ensured in this manner that the tables can only be arranged relative to one another in certain relationships of distance and of angle, wherein the relative distance of the workplace pieces of furniture preferably changes as intended as a function of the angle of orientation.

An especially advantageous embodiment of the disclosure provides that the workplace pieces of furniture are tables, in particular office tables. In the case of office tables an especially suitable arrangement of the tables can be achieved by such an arrangement which can be selected to be infinitely variable relative to one another between an arrangement in which they are aligned adjacent to one another and an arrangement at an angle of, e.g., 90°.

It is advantageously provided that the tables each comprise a table frame and advantageously comprise a standing leg on which the rotary, movable connecting means is arranged or constructed. A table leg is especially suitable which extends downward approximately in the middle axis of the tables adjacent to a side edge of a table and on the end of which a standing foot is arranged. The standing foot, on which the connection means of the invention is advantageously arranged or constructed, is designed in a V shape and constructed in such a manner that each arm of the V-shaped standing foot is at the same time a part of the connection means.

Another advantageous embodiment of the disclosure provides that the rotary, movable connection means consists of at least a first connection arm of the first table, a second connection arm of the second table and of a rotary articulation arranged between the two connection arms.

An embodiment of a workplace system is especially advantageous in which the rotary, movable connection means runs along the floor or just above the floor (close to the floor). In this manner a through space can be created between the tables as access to areas located behind them in spite of the connection means. To this extent a flat design of the connection arms close to the floor is also advantageous for realizing a flat construction of the connection.

Another advantageous embodiment of the disclosure provides that each workplace piece of furniture comprises a foot, preferably a V-shaped or Y-shaped foot consisting of two foot sections oriented at an angle relative to one another, wherein the feet are preferably arranged adjacent to the lower end of a standing leg (close to the floor or supported on the floor surface).

It is especially advantageous if a foot section of the preferably V-shaped or Y-shaped foot sections of each foot forms a connection arm of the connection means. In this manner the foot sections perform two functions. They serve in the first place as foot support for stabilizing the fixed table stand and on the other and as part of the connection means between the tables.

Furthermore, it is advantageous if the connection articulation is constructed as a detachable articulation for the assembly so that the setting up of the tables takes place in a simpler and more convenient manner.

Another advantageous embodiment of the disclosure provides that at least one table has a height-adjustable table frame in order to be able to adjust the table working plate of the table in height. In this manner an expansion of the working space can be achieved not only at a distance and a relative angle of rotation of the tables but also in their height relative to one another.

The connection arms of the workplace pieces of furniture can be arranged with advantage at a changeable angle β to one another in such a manner that the distance of the tables, measured at the end of the connection arms to one another, changes in such a manner that as the angle β changes in an angular range of 90° to 180°, the distance changes up to a maximum value. However, for this the connection arm opposite the table to which it is fastened is firmly mounted so that the distance of the tables from one another is changed by changing the angle β, i.e. by a relative rotating of one of the tables relative to the other one.

Furthermore, it is advantageous if the adjacent table side edges, which are arranged above the connecting element when observed from above, run in the front area located in the direction of the front table edge in such a manner that the distance between the side table edges becomes larger at least in sections at least an angle β=90° in the direction of the front table edge.

In other words, this means that the right front area of the one table and the left front area of the other table connected to it comprise an obliquely shortened table plate.

Other advantageous further developments of the disclosure are shown in detail in the following together with the description of the preferred embodiment of the disclosure using the figures.

DRAWINGS

DESCRIPTION

The disclosure is explained in detail in the following with reference made to the FIGS. 1 to 7, wherein the same reference numbers in the figures refer to the same structural and/or functional features.

Figure 1:
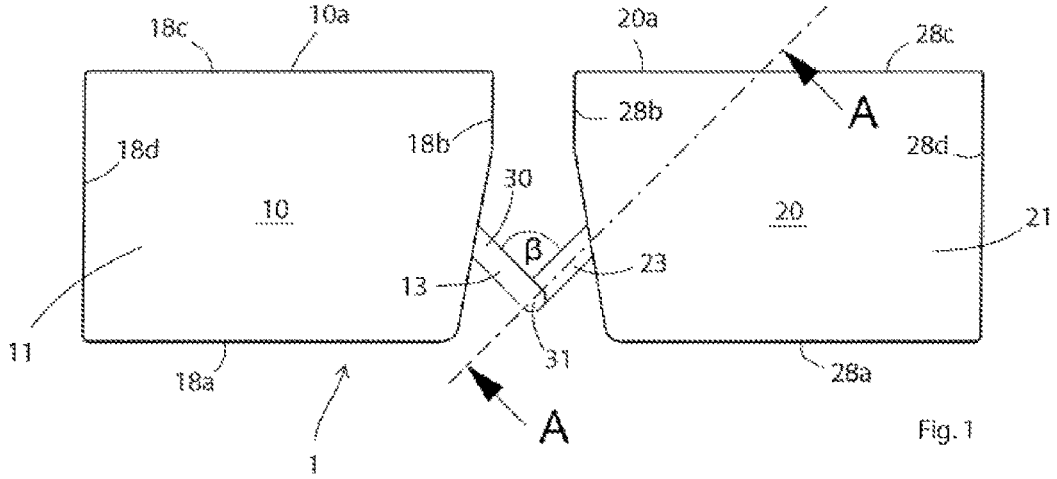
FIG. 1 shows a view of an exemplary embodiment of a table system of the disclosure consisting of two tables.

FIG. 1 shows a top view of an exemplary embodiment of a workplace system according to the disclosure, namely a table system 1 consisting of two tables 10, 20. The tables 10, 20 each comprise a table plate (10*a*, 20*a*) each with a work surface 11, 21.

The two tables 10, 20 are connected to one another in a rotating, movable manner by a rotating, movable connection means 30 via the rotary articulation 31. Accordingly, the table 20 can be rotated through an angle β relative to the table 10. In the view of FIG. 1 the angle β=90°. In such a mounting position of the two tables relative to one another the tables are arranged in series adjacent to one another and the front table edges 18*a*, 28*a* and the rear table edges 18*c*, 28*c* run in a parallel manner. The two tables side edges 18*d*, 28*d*, which face away from one another, also run in parallel while the immediately adjacent table edges 18*b*, 28*b* run away from one another.

Figure 2:
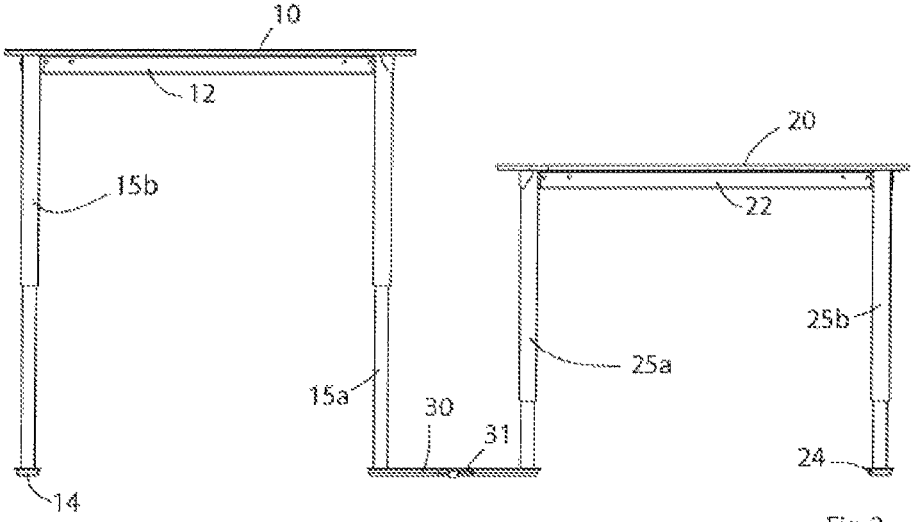
FIG. 2 shows a front view of the exemplary embodiment according to FIG. 1.
Figure 3:
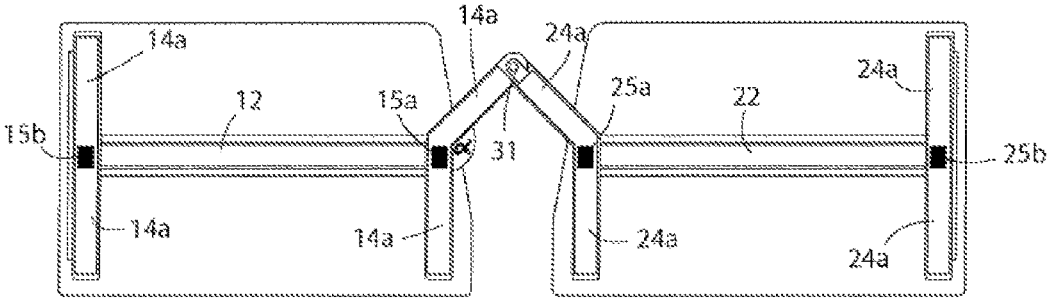
FIG. 3 shows a bottom view of the exemplary embodiment according to FIG. 1.

As can furthermore be seen, e.g., from the FIGS. 2 and 3, the tables 10, 20 each have a table frame 12, 22 and a standing leg 15*a*, 25*a* on which the rotary, movable connection means 30 is arranged and constructed. Furthermore, another traditional standing leg 15*b*, 25*b* is on the particular opposite (outer) table side of the tables 10, 20.

It can be readily recognized in the bottom view according to FIG. 3 that a foot (14, 24) consisting of two foot sections 14*a*, 24*a* is formed on the lower end of the table legs 15*a*, 15*b* and 25*a*, 25*b*.

The rotary, movable connection means 30 consists here of a first foot section 14*a* of the V-shaped foot 14 of the first table 10 and of a second foot section 24*a* of the foot 24 of the V-shaped foot of the second table 20, wherein the two foot sections 14*a*, 24*a* are connected to one another by a rotary articulation 31.

Therefore, the two foot sections 14*a*, 24*a* are simultaneously the connection arms 13, 23 between the two tables in this exemplary embodiment. In a less advantageous embodiment the connection arms could also be arranged further above and separated from the table legs.

Furthermore, the position of the table legs 15*a*, 15*b*, 25*a*, 25*b* and of the supports of the table which form the vertical sections of the table legs are shown in the bottom view of FIG. 3.

Figure 4:
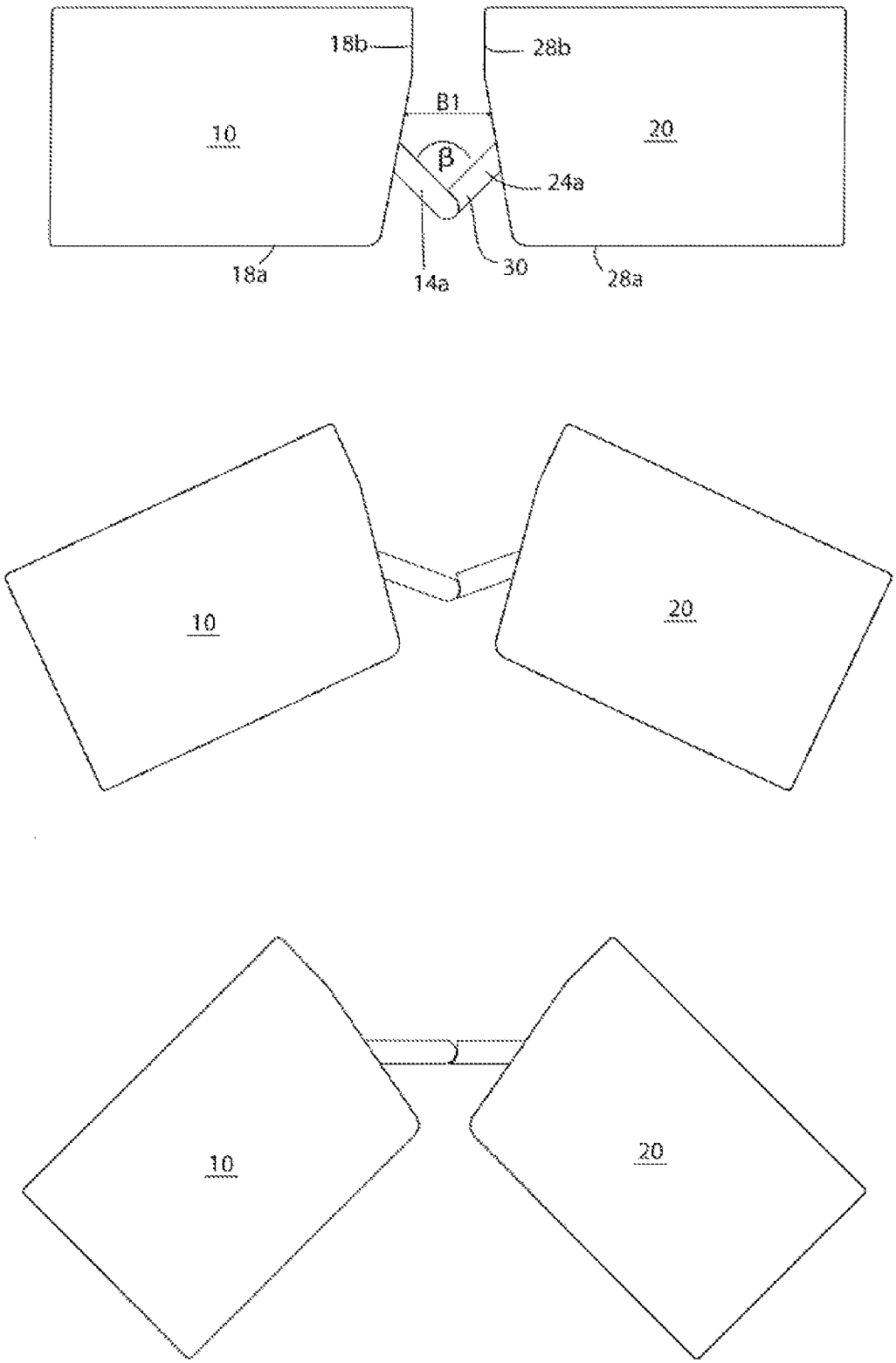
FIG. 4 shows a view of the table system of the exemplary embodiment according to FIG. 1 in different mounting positions.
Figure 5:
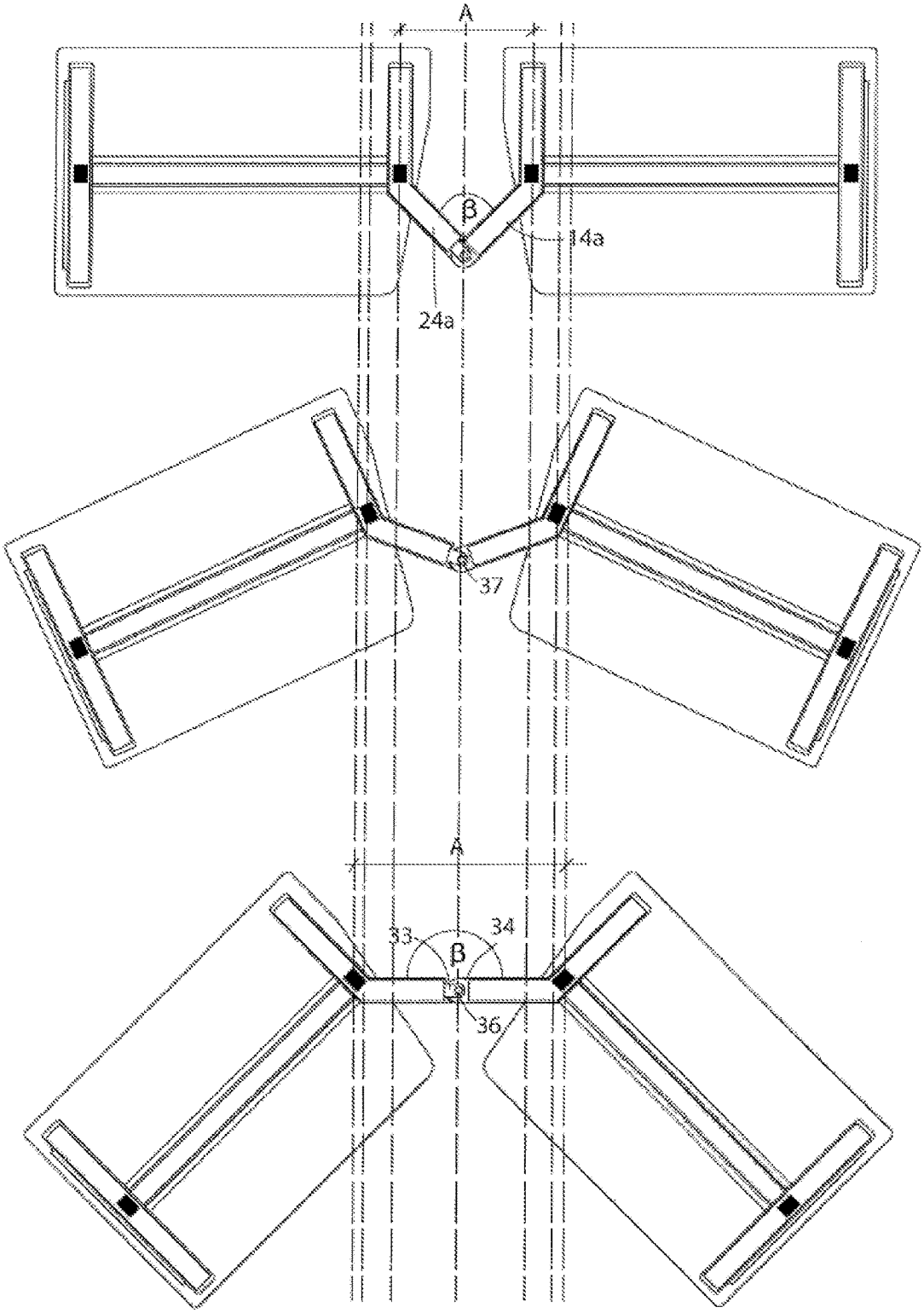
FIG. 5 shows the mounting positions of FIG. 4 in a bottom view.

FIGS. 4 and 5 show a view of the table system 1 of the exemplary embodiment according to FIG. 1 in different mounting positions (once in a top view and once in a bottom view (with sketched-in dotted help lines).

The top view shows a mounting position in which the angle β between the foot sections 14*a*, 24*a* participating in the connection element 30 is approximately 90° and the tables are accordingly arranged adjacent to one another in series. The relative position of the tables to one another is accordingly 0° or 180° (as a consequence of the mirror-image alignment of the tables). As can be readily recognized from the help lines in FIG. 5, the distance A between the table legs 15*a*, 25*a* at the angle β of 90° is minimal whereas the distance A at the maximal angle of β=180°, as can be seen in the lower view of FIGS. 4 and 5, is maximal.

The middle view shows an intermediate state at an angle β of approximately 130° and a distance A between the table legs 15*a*, 25*a* which is less in comparison to the lower view A.

The lateral table edges 18*b*, 28*b* (side edges) which are immediately adjacent in the FIG. 4 in the top view and which are arranged above the connection element 30, viewed vertically upward, run in an area located in the front of the particular table front edge 18*a*, 28*a* so that the distance B1 becomes greater between the lateral table edges 18*b*, 28*b* at an angle β=90° in the direction of the front table edge 18*a*, 28*a* at least in sections. This has the advantage that in an arrangement of the tables 10, 20 in a lower view such as shown in FIG. 4 in which the angle β=180°, not only is a collision between the table corners concerned prevented but a remaining distance is ensured.

Figure 6:
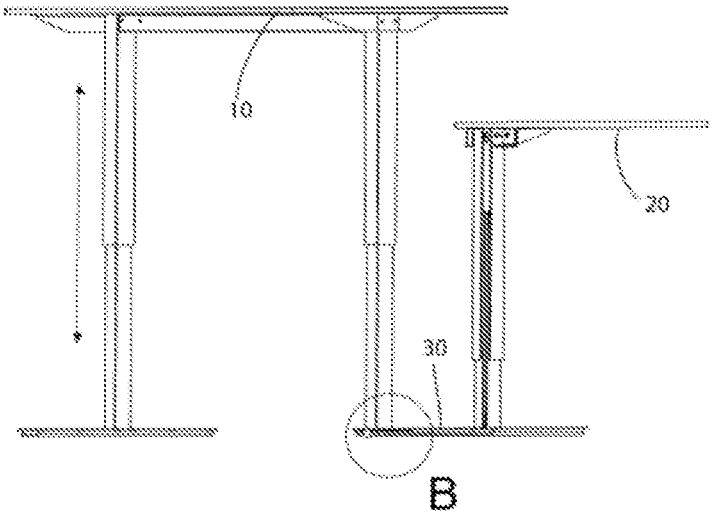
FIG. 6 shows a sectional view along intersection line A-A in FIG. 1.
Figure 7:
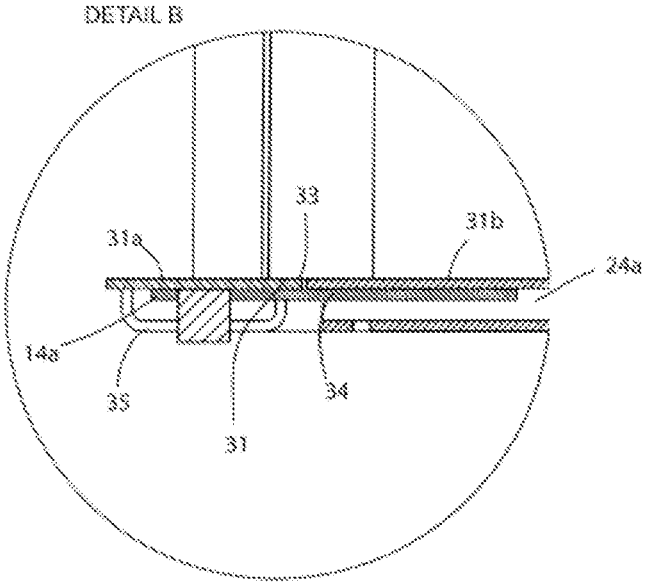
FIG. 7 shows a detail of the rotary articulation of the table system of FIG. 6.

FIG. 6 shows a sectional view along the section line A-A from FIG. 1 and FIG. 7 shows a detail of the rotary articulation of the table system from FIG. 6. As FIG. 6 shows, the tables 10, 20 can be adjusted in height. The articulation 31 consists of two flat articulation plates 31*a*, 31*b* which are formed by the foot parts 14*a*, 24*a* on the end side. The end of the one foot part 14*a* of the first table 10 is semicircular and engages into a corresponding partially circular recess on the end of the other foot part 24*a* of the second table 20. A U-shaped profile 35 on which a flat profile is placed runs along the bottom of the foot parts 14*a*, 24*a*.

As is shown in FIG. 4 (lower illustration), an articulation web 33 on the front side on the first foot part 14*a* and with an opening 36 formed in it projects over the flat part 34 of the other foot part 24*a* and is connected to the latter by an articulation about the shaft 37 in a rotary, movable manner.

The disclosure is not limited in its execution to the above-indicated preferred exemplary embodiments but rather a number of variants is conceivable which make use of the presented solution even in the case of basically differently designed embodiments.

The invention claimed is:

1. A workplace system comprising:

at least two workplace pieces of furniture which make a work surface available, wherein the workplace pieces of furniture are connected to one another by a rotary, movable connection means, the rotary, movable connection means runs along a floor;

wherein each workplace piece of furniture comprises a V-shaped foot including two foot sections oriented at an angle β relative to one another, wherein the feet are arranged adjacent to a lower end of a standing leg; and a foot section of each foot forms a connection arm of the rotary, movable connection means.

2. The workplace system according to claim 1, wherein the workplace pieces of furniture are tables.

3. The workplace system according to claim 2, wherein the tables each comprise a table plate and a standing leg, on which the rotary, movable connecting means is arranged or constructed.

4. The workplace system according to claim 2, wherein the rotary, movable connection means includes at least a first connection arm of a first table, a second connection arm of a second table and a rotary articulation arranged between the two connection arms.

5. The workplace system according to claim 4, wherein the connection arms of the workplace pieces of furniture can be arranged at a changeable angle β to one another in such a manner that a distance of the tables, measured at an end of the connection arms to one another, changes in such a manner that as the angle β changes in an angular range of 90° to 180°, the distance changes up to a maximum value.

6. The workplace system according to claim 2, wherein at least one table has a height-adjustable table frame in order to be able to adjust a table working plate of the table in height.

7. The workplace system according to claim 2, wherein adjacent table side edges, which are arranged above the connecting element when observed from above, run in a front area located in a direction of a front table edge in such a manner that a distance between the table side edges becomes larger at least in sections at an angle β=90° in the direction of the front table edge.

8. A workplace system comprising:

at least two workplace pieces of furniture which make a work surface available, wherein the workplace pieces of furniture are connected to one another by a rotary, movable connection means, the rotary, movable connection means runs along a floor; and each workplace piece of furniture comprises a V-shaped foot including two foot sections oriented at an angle β relative to one another, wherein the feet are arranged adjacent to a lower end of a standing leg.

9. The workplace system according to claim 8, wherein the workplace pieces of furniture are tables.

10. The workplace system according to claim 9, wherein the tables each comprise a table plate and a standing leg, on which the rotary, movable connecting means is arranged or constructed.

11. The workplace system according to claim 9, wherein the rotary, movable connection means includes at least a first connection arm of a first table, a second connection arm of a second table and a rotary articulation arranged between the two connection arms.

12. The workplace system according to claim 11, wherein the connection arms of the workplace pieces of furniture can be arranged at a changeable angle β to one another in such a manner that a distance of the tables, measured at an end of the connection arms to one another, changes in such a manner that as the angle β changes in an angular range of 90° to 180°, the distance changes up to a maximum value.

13. The workplace system according to claim 9, wherein at least one table has a height-adjustable table frame in order to be able to adjust a table working plate of the table in height.

14. The workplace system according to claim 9, wherein adjacent table side edges, which are arranged above the connecting element when observed from above, run in a front area located in a direction of a front table edge in such a manner that a distance between the table side edges becomes larger at least in sections at an angle β=90° in the direction of the front table edge.

* * * * *